US011952686B2

(12) United States Patent
Platz et al.

(10) Patent No.: US 11,952,686 B2
(45) Date of Patent: Apr. 9, 2024

(54) COMPRESSION ARTICLE

(71) Applicant: BSN-JOBST GmbH, Emmerich (DE)

(72) Inventors: Sascha Platz, Kleve (DE); Joachim Bauer, Hamburg (DE); Bernhard Frankenberg, Silberhausen (DE)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 517 days.

(21) Appl. No.: 17/057,158

(22) PCT Filed: May 21, 2019

(86) PCT No.: PCT/EP2019/063124
§ 371 (c)(1),
(2) Date: Nov. 20, 2020

(87) PCT Pub. No.: WO2019/224204
PCT Pub. Date: Nov. 28, 2019

(65) Prior Publication Data

US 2021/0130992 A1 May 6, 2021

(30) Foreign Application Priority Data

May 23, 2018 (EP) ..... 18173788

(51) Int. Cl.
*D04B 1/26* (2006.01)

(52) U.S. Cl.
CPC ..... *D04B 1/265* (2013.01); *D10B 2403/0333* (2013.01); *D10B 2509/028* (2013.01)

(58) Field of Classification Search
CPC ..... D04B 1/265; D04B 9/52; D04B 7/32
(Continued)

(56) References Cited

U.S. PATENT DOCUMENTS 869,986 A 11/1907 Scott
1,883,581 A * 10/1932 Thornton ..... D04B 9/38 66/51

(Continued)

FOREIGN PATENT DOCUMENTS

CH 421359 A 9/1966
DE 4204339 A1 8/1993

(Continued)

OTHER PUBLICATIONS

International Searching Authority, Search Report issued in International Application No. PCT/EP2019/063124, dated Jul. 9, 2019 (5 pages).

(Continued)

*Primary Examiner* — Danny Worrell
(74) *Attorney, Agent, or Firm* — CANTOR COLBURN LLP

(57) ABSTRACT

A compression article and method for its production on a flat-bed knitting machine are provided for providing an improved fit to a body part. In the compression article, respectively the number of stitches per stitch row is matched to the radial circumference of the body part to be treated by the compression article. The compression article has a plurality of points which are distributed over its circumference and at which, in a stitch row, at least one of a stitch increase and a stitch reduction is realized. The number of stitches in the wale direction varies over the circumference of the compression article and is matched, in the longitudinal direction of the body part, to the shape of the body part to be treated.

33 Claims, 2 Drawing Sheets

(58) Field of Classification Search
USPC ..... 66/189, 178 A
See application file for complete search history.

(56) References Cited

U.S. PATENT DOCUMENTS

| | | | | | |
|---|---|---|---|---|---|
| 2,574,873 | A * | 11/1951 | Jobst | A61F 13/08 | 33/15 |
| 2,841,971 | A * | 7/1958 | Bird | A41B 11/00 | 66/178 A |
| 3,889,494 | A * | 6/1975 | Patience | D04B 1/265 | 66/189 |
| 3,975,929 | A * | 8/1976 | Fregeolle | D04B 1/18 | 66/178 A |
| 4,027,667 | A * | 6/1977 | Swallow | D04B 9/52 | 602/76 |
| 4,048,818 | A * | 9/1977 | Cueman | D04B 1/265 | 66/185 |
| 4,172,456 | A * | 10/1979 | Zens | D04B 1/265 | 66/178 A |
| 4,180,065 | A * | 12/1979 | Bowen | D04B 9/025 | 66/178 A |
| 4,502,301 | A * | 3/1985 | Swallow | A61F 13/08 | 66/178 A |
| 4,527,402 | A | 7/1985 | Swallow et al. | | |
| 5,388,050 | A * | 2/1995 | Inoue | D04B 37/02 | 700/86 |
| 5,735,145 | A | 4/1998 | Pernick | | |
| 5,896,758 | A | 4/1999 | Rock et al. | | |
| 6,151,922 | A | 11/2000 | Shimasaki | | |
| 6,427,493 | B1 | 8/2002 | Kasdan et al. | | |
| 6,725,691 | B2 * | 4/2004 | Yakopson | D02G 3/328 | 66/178 R |
| 7,043,329 | B2 * | 5/2006 | Dias | D04B 15/50 | 66/55 |
| 7,360,378 | B2 | 4/2008 | Foshee | | |
| 7,895,863 | B2 * | 3/2011 | Smith | A61F 13/08 | 66/172 E |
| 8,317,736 | B2 * | 11/2012 | Virkus | A61F 13/08 | 602/61 |
| 9,534,324 | B2 * | 1/2017 | Lonati | D04B 15/58 | |
| 9,777,413 | B2 * | 10/2017 | Messier | A61F 13/08 | |
| 9,828,705 | B1 | 11/2017 | Shiue | | |
| 10,271,581 | B2 * | 4/2019 | Kehler | D04B 21/08 | |
| 10,273,607 | B2 * | 4/2019 | Stein | D04B 1/265 | |
| 10,645,978 | B2 * | 5/2020 | Kehler | A41D 1/04 | |
| 10,900,152 | B2 * | 1/2021 | Sasaki | D04B 1/22 | |
| 10,954,614 | B2 * | 3/2021 | Giorgini | D04B 1/246 | |
| 11,131,044 | B2 * | 9/2021 | Convert | D04B 15/18 | |
| 11,134,725 | B2 * | 10/2021 | Erkus | D03D 15/00 | |
| 11,560,651 | B2 * | 1/2023 | Rock | D04B 1/102 | |
| 2010/0130903 | A1 * | 5/2010 | Rock | D04B 1/243 | 602/62 |
| 2016/0076175 | A1 * | 3/2016 | Rock | D04B 1/18 | 66/196 |
| 2017/0247822 | A1 | 8/2017 | Atmanspacher | | |
| 2020/0385901 | A1 | 12/2020 | Lawrence | | |
| 2022/0154372 | A1 | 5/2022 | Platz et al. | | |

FOREIGN PATENT DOCUMENTS

| | | | |
|---|---|---|---|
| DE | 19616005 | A1 | 10/1997 |
| DE | 20207156 | U1 | 8/2002 |
| DE | 20309726 | U1 | 9/2003 |
| DE | 102006048313 | A1 | 4/2008 |
| DE | 102008031845 | A1 | 1/2010 |
| DE | 102012004150 | A1 | 8/2013 |
| DE | 102015115228 | B3 | 9/2016 |
| DE | 202017100286 | U1 | 4/2018 |
| EP | 0522778 | B1 | 8/1997 |
| EP | 0989219 | A2 | 3/2000 |
| EP | 1321551 | A1 | 6/2003 |
| EP | 1621164 | A1 | 2/2006 |
| EP | 2075361 | A1 | 7/2009 |
| EP | 2436276 | A1 | 4/2012 |
| EP | 3085822 | A1 | 10/2016 |
| EP | 3214213 | A1 | 9/2017 |
| EP | 3251641 | A1 | 12/2017 |
| EP | 3572570 | A1 | 11/2019 |
| WO | 9207128 | A1 | 4/1992 |
| WO | 03040449 | A1 | 5/2003 |
| WO | 2005106087 | A1 | 11/2005 |
| WO | 2006064816 | A1 | 6/2006 |
| WO | 2010006051 | A1 | 1/2010 |

OTHER PUBLICATIONS

International Searching Authority, International Preliminary Report on Patentability issued in International Application No. PCT/EP20198/059506, mailed Jul. 20, 2021 (12 pages).
International Searching Authority, International Search Report issued in International Application No. PCT/EP2019/059506, mailed Mar. 1, 2020 (3 pages).
PCT International Preliminary Report on Patentability; International Application No. PCT/EP2019/063124; International Filing Date: May 21, 2019; dated Nov. 24, 2020; pp. 1-8.
PCT ISR Written Opinion with English Translation; International Application No. PCT/EP2019/063124; International Filing Date: May 21, 2019; Date of Mailing Jul. 9, 2019; pp. 1-14.
U.S. Appl. No. 17/602,797, filed Oct. 11, 2021; Non-Final Office Action dated Feb. 2, 2023; 11 pages.
Advertising Brochure; "EquiCrown® Compression Bandages"; Aug. 2014; 6 pages.
Advertising Brochure; "EquiCrown® Medical Compression Bandages"; Jun. 2013; 2 pages.
Affidavit of Mr. Yusuke Miyaj; Date: Feb. 10, 2023; 2 pages.
Confirmation from the company Shima Seike MFG., LTD, Japan, regarding the publication of a knitting program 5249W00F for the production of a compression sock; Date: Aug. 17, 2022; 1 page.
Database extract regarding incoming orders and order No. for Teccons eK Reisholzstr. 39, 40721 Hilden; Date: Jan. 16, 2014; 1 page.
Delivery confirmation for a compression stocking knitted according to the program Y5249W00F; Date: May 3, 2022; 2 pages.
Delivery Note from Julius Zorn GmbH to Pet Physio c/o MBE Mailboxes ect.; Lieferschein 103401000360; Date: Jan. 16, 2014; 3 pages.
EquiCrown® Price List; Julius Zorn GmbH; May 2014; 1 page.
Invoice from Julius Zorn GmbH to Pet Physio c/o MBE Mailboxes ect.; Rechnung 103401000360; Date: Jan. 16, 2014; 3 pages.
Notice of Opposition to European Patent EP3572570B1 with English translation; Patent Proprietor: BSN-Jobst GmbH; Opponent: Medi GmbH & Co. KG; Dated Feb. 21, 2023; 127 pages.
Notice of Opposition to European Patent EP3572570B1 with English translation; Patent Proprietor: BSN-Jobst GmbH; Opponent: Ofa Bamberg GmbH; Dated Feb. 20, 2023; 67 pages.
Order From Teccons eK, Reisholzstr. 39, 40721 Hilden vom; Date: Jan. 16, 2014; 3 pages.
Picture bundle with Pictures E20a—E20i for an EquiCrown@ compression bandage art 6600 PVK Gr. 1, Produced on Date: Jul. 11, 2013; 9 pages.
Picture bundle with the pictures E24a—E24e concerning the exhibition of a compression stocking knitted according to the program Y5249W00F at the anniversary celebration for the 55th anniversary of the company Shima Seike MFG., LTD on Nov. 16-17, 2017; 3 pages.
Picture set with pictures E26a-E26f concerning the Compression stocking knitted according to the program Y5249W00F; Date registered: Nov. 13, 2017; 5 pages.
Pictures E21a-E21h of EquiCrown compression bandage with enlarged view and designation of various relevant knitting areas; Jul. 11, 2013; 3 pages.
Proof of registration of the knitting program Y5249W00F from Nov. 13, 2017 on the user website of Shima Seike MFG., LTD for user download; Date: Nov. 13, 2017; 1 page.
Quality assurance RAL-GZ 387/1 "Medical Compression Hosiery", Jan. 2008 edition, of the German Institute for Quality Assurance and Certification; 24 pages.

(56) References Cited

OTHER PUBLICATIONS

Response to Notice of Opposition to European Patent EP3572570B1; In the name of BSN-Jobst GmbH; Opponent 1: Medi GmbH; Opponent 2: OFA Bamberg GmbH; Dated Jul. 11, 2023; 25 pages.
Textbook "Compression therapy"; K. Protz, 1. Dissmond, K. Kröger, Heidelberg 2016; ISBN: 978-3-662-49743-2.

* cited by examiner

COMPRESSION ARTICLE

CROSS-REFERENCE TO RELATED APPLICATIONS

This application is a national phase entry of, and claims priority to, International Application No. PCT/EP2019/063124, filed May 21, 2019, which claims priority to European Patent Application No. 18173788.3, filed May 23, 2018. The above-mentioned patent applications are incorporated herein by reference in their entireties.

TECHNICAL FIELD

This application relates to a compression article, which is produced on a knitting machine.

BACKGROUND

For the avoidance or treatment of edemas, varicose veins, venous insufficiency, as well as after vein surgery procedures, such compression articles in the form of compression stockings, compression gloves, foot caps and the like are used. Other elastic articles include joint bandages and also burn bandages. In sport, support bandages are used to protect from injuries and partially also to enhance performance.

Due to the good elastic characteristics, these articles are primarily produced as knitted fabrics, whereby production on a flat-bed knitting machine is the rule. The article is produced as a flat knitted fabric, the longitudinal margins of which are subsequently sewn together, so that the desired three-dimensional article is obtained. The flat knitted fabric is, in regions in which the body part to be treated has a larger circumference, knitted with more stitches per row than in regions of a smaller circumference. The stitch-increases and the stitch-reductions are performed at the margins of the flat knitted fabric. This means that, after the closure of the longitudinal seam of the flat knitted fabric, this longitudinal seam has a curved path, while the opposite circumferential region of the compression article runs completely straight in the longitudinal direction. The shape of the compression article thus only imperfectly replicates the anatomy of the body part. The longitudinal axes of the compression article and of the body part do not coincide.

In patients, bulges and dimensional changes of the relevant body part are however possible at all points on the circumference. A lower leg of such a patient may not only have muscle-related circumferential widening in the calf region but also bulges in the shinbone region. The known available compression articles, even given a precise measurement of the body part and a customized production of the compression article, are not sufficiently well fitting. Moreover, the currently used, above-described flat knitting technology is only partially suitable for the production of products of this type.

Therefore, it would be desirable to provide compression articles having an improved fit.

SUMMARY

According to embodiments of the present invention, the technical objects identified above are achieved by a compression article which is produced from a knitted fabric created on a knitting machine, in particular a flat-bed knitting machine, and in which respectively the number of stitches per stitch row is matched to the radial circumference of the body part to be treated by the compression article. The compression article is characterized in that, in order to be matched in the circumferential direction to the shape of the body part to be treated, it has a plurality of points which are distributed over its circumference and at which, in a stitch row, a stitch increase and/or a stitch reduction is carried out, and in that, moreover, the number of stitches in the wale direction varies over the circumference of the compression article. The compression article is thus further matched longitudinally to the shape of the body part to be treated.

In such embodiments, the compression article according to the invention is distinguished by the fact that stitch increases and/or stitch reductions are realized at those points on the circumference at which the body part to be supported likewise undergoes a change in its circumference and no longer just in the region of the longitudinal seam of the article. Moreover, the fit in the longitudinal direction is improved by virtue of the fact that also the number of stitches in the wale direction of the compression article varies over the circumference thereof. Thus, a compression stocking, for instance, can have more stitch rows in the calf region than in the shinbone region. Hence, not only can a better fit of the compression article be obtained but also a more even distribution of the compression pressure over the body part. The three-dimensionally knitted article therefore has, in addition to an improved fit, also an improved effectiveness.

In one embodiment, the compression article can be knitted such that its central longitudinal axis conforms to the central longitudinal axis of the body part to be treated. Particularly uniform pressure conditions over the circumference of the body part can thereby be achieved.

Furthermore, it is an advantage if the compression article is produced as a three-dimensional flat or circular knitted fabric. As a result of stitch accumulation in a mid-region of the knitted fabric, a three-dimensional structure is formed. The compression article can, however, also be produced as a seamless tubular knitted fabric and hence acquire a three-dimensional shape. The step of subsequently sewing together the margins of the knitted fabric can then be dispensed with.

In another embodiment, the compression article can additionally be produced using gusseting techniques. With gusseting techniques in conjunction with stitch increase and/or stitch decrease distributed over the circumference, almost any chosen three-dimensional structures can be produced.

In a preferred embodiment, the compression article can be formed of a plurality of strip-shaped segments, which, in the circumferential direction of the compression article, are separated from one another by zones comprising stitch increases and/or stitch decreases.

Depending on the number of segments, compression articles in which a stitch increase and/or a stitch reduction is present at a plurality of points on the circumference are thus able to be produced in a technically relatively simple manner. The side margins of the segments can be parallel or non-parallel to one another.

In further embodiments, at least some of the segments can have a different number of stitch rows or a different length of the wales (equal to number of stitches per wale) in order to be able to also closely match the compression article to the contour of the body part in its longitudinal direction. Preferably, the division of the knitted fabric into segments, the stitch count per stitch row in the segments and the number of stitch rows per segment can accordingly be determined from data acquired in the measurement of the body part to be supported.

In some embodiments, the compression article can be produced at least partially using elastic yarns, as known per se. The elastic threads can here form the ground weave of the article and/or be integrated as weft and/or warp threads.

In certain embodiments, further advantages are obtained if the compression pressure exerted on the body part by the compression article decreases from the distal end of the article toward the proximal end. This provision aids the drainage of lymph fluid toward the heart and hence promotes the excretion of excess fluid from the body.

In one embodiment, the compression article can be produced from a double-faced or double-layered knitted fabric. The knitted fabric can be produced, for instance, from an R-R binding. Or it can have a plurality of R-L layers, which are connected to one another full-face or at certain points.

In another embodiment, a first method is provided for producing a compression article on a knitting machine, in particular a flat-bed knitting machine. The method includes the steps of:

- measurement of the body part to be supported by the compression article at individual measuring points;
- selection of a base pattern for the compression article from a catalogue, the measurements of which best conform to the measured body part;
- adjustment of the stitch count of the stitch rows and of the number of stitches in the individual wales of the base pattern in accordance with the measurements of the body part between the measuring points; and
- knitting of the revised base pattern on a knitting machine, in particular a flat-bed knitting machine.

This method is suitable for the production of compression articles with very good fit. It is advantageous that the revised base pattern is produced by calculating a plurality of segments, wherein the segments are respectively separated from one another by zones in which the stitch count of the stitch rows of the knitted fabric is reduced and/or increased. The number of segments can be predefined or freely chosen.

According to another embodiment, an alternative method for producing a compression article on a knitting machine, in particular a flat-bed knitting machine, includes the steps of:

- measurement of the body part to be supported by the compression article, by scanning of the body part;
- calculation of the necessary number of stitches per stitch row in accordance with the measured circumference of the body part in that region of the body part that is covered by the stitch row;
- calculation of those points within each stitch row at which a stitch increase and/or decrease in comparison to the preceding stitch row is necessary, so that the central longitudinal axis of the compression knitted fabric conforms to the central longitudinal axis of the body part;
- calculation of the necessary number of stitches per wale of the compression article for covering the body part in the longitudinal direction thereof; and
- knitting of the compression article on a flat-bed knitting machine, using the calculated stitch counts per stitch row, the calculated points of a stitch increase and/or decrease in the stitch rows, and the calculated necessary numbers of stitches per wale.

This method may require the full scanning of the body part to be supported. From this measurement data, the necessary stitch count and/or gusset points for the optimal fit of the compression article are then calculated row by row. A stitch increase or a stitch reduction can now be provided at each point within a stitch row, not just at the margins of segments. This more complex method is suitable for the production of compression articles for patients having complaints for which a perfect fit and an optimal compression pressure distribution are desired.

BRIEF DESCRIPTION OF THE DRAWINGS

The features and advantages of the invention will be appreciated upon reference to the following drawings. The accompanying drawings, which are incorporated in and constitute a part of this specification, illustrate one or more embodiments of the invention and, together with the general description given above and the detailed description given below, explain the one or more embodiments of the invention.

DETAILED DESCRIPTION

Figure 1:
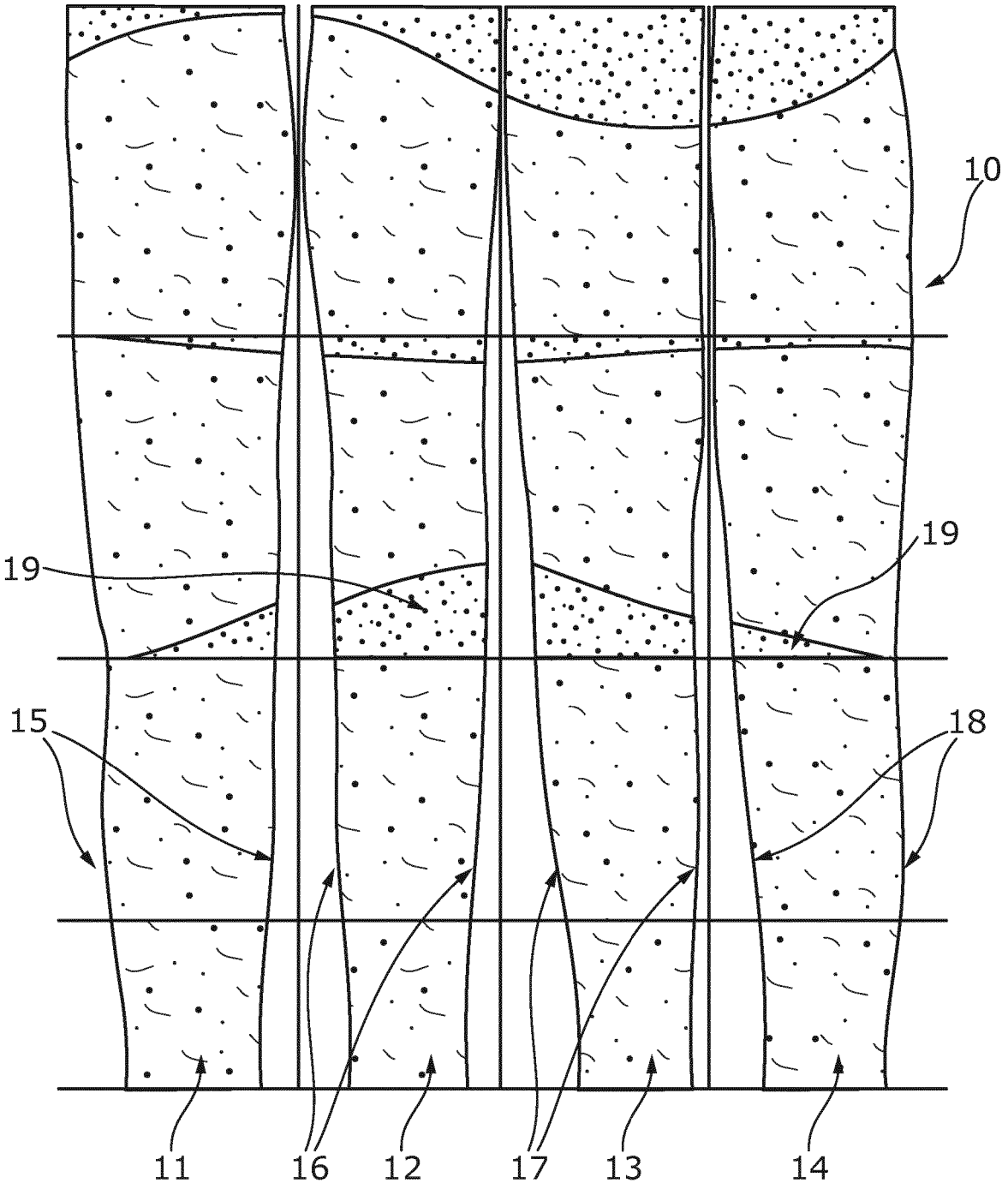
FIG. 1 is a top view of segments of a base pattern for a compression article.
Figure 2:
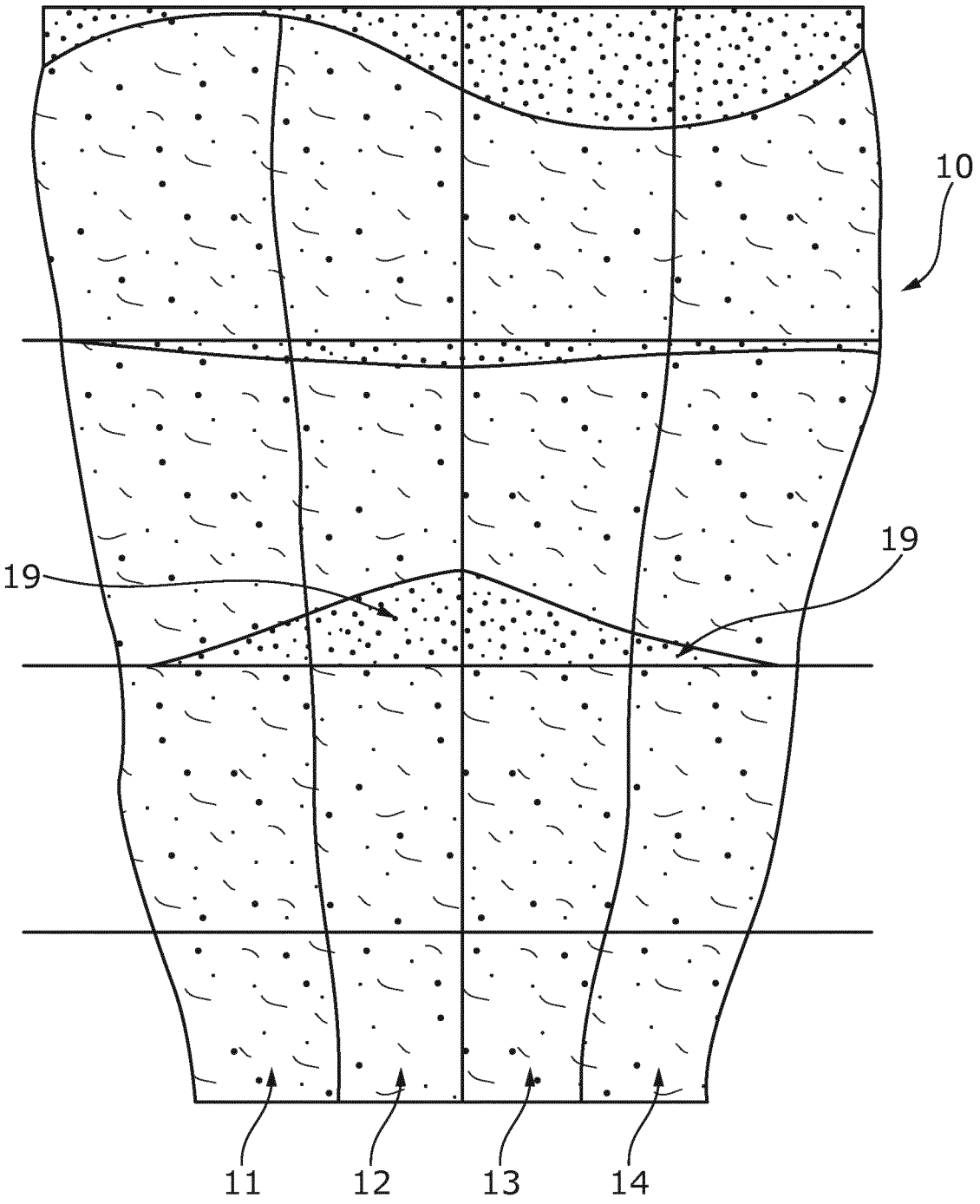
FIG. 2 is a top view of the compression article from FIG. 1 after completion on a flat-bed knitting machine.

In the illustrated example, the compression article 10 shown in FIGS. 1 and 2 is produced on a flat-bed knitting machine and is divided in the design stage into four segments 11, 12, 13 and 14, which between them define zones 15-18 in which a stitch increase and/or a stitch reduction is carried out. The four segments 11 to 14 are knitted with common thread guides, so that the finished knitted fabric shown in FIG. 2 is obtained. The representation in FIG. 1 serves, however, to better illustrate the production method for the compression article 10 (also referred to as the compression knitted fabric herein).

Each of the segments 11 to 14 is adapted in the zones 15 to 18 at the longitudinal margins of the segments 11 to 14 with respect to the stitch count in each stitch row such that the finished knitted compression article 10 is optimally matched in its shape to a body part to be supported. To this end, measurement data of the body part is first used to select a base pattern for the compression article 10 from a set of available patterns which already approximates to the desired shape of the compression article 10. The patterns of the segments 11 to 14 of this base pattern are subsequently revised such that the fit of the compression article 10 composed of the segments is optimally matched to the shape of the body part. This revision is made by adapting the stitch count per stitch row in the zones 15 to 18 at the longitudinal margins of the segments 11 to 14 and by providing gusseting zones 19 at least in some of the segments 11 to 14. Also the length of the wales of the segments 11 to 14 is varied in accordance with the body part shape. There is thus formed the three-dimensional compression article 10 shown in FIG. 2, which has merely to be closed by a longitudinal seam.

The embodiments described above are descriptions of preferred embodiments of the present invention, and are not intended to limit the scope of the present invention. Various variations and modifications can be made by those of ordinary skill in the art, without departing from the design and scope of the present invention. The variations and modifications should all fall within the claimed scope defined by the claims of the present invention.

What is claimed is:

1. A compression article, which is produced from a three-dimensional flat-knitted fabric created on a knitting machine and in which a number of stitches are provided in rows in a circumferential direction and wales in a longitudinal direction respectively and the number of stitches per row is matched to a radial circumference of a body part to be treated by the compression article, wherein, in order to match in the circumferential direction a shape of the body part to be treated, the compression article has a plurality of points at which, in a row, a stitch increase or a stitch reduction with respect to a preceding row is realized, and in that, moreover, the number of stitches in a wale varies over the circumference of the compression article whereby the compression article is additionally matched, in the longitudinal direction, to the shape of the body part to be treated and further in that the compression article is formed of a plurality of strip-shaped segments, which, in the circumferential direction, are separated from one another by zones of varying width in which the stitch increases or stitch decreases are located and the compression article is formed by closing the three-dimensional flat knitted fabric with a longitudinal seam.

2. A compression article produced from a knitted fabric created on a knitting machine and in which a number of stitches are provided in rows in a circumferential direction and wales in a longitudinal direction respectively and the number of stitches per row is matched to a radial circumference of the body part to be treated by the compression article, wherein the compression article is a compression stocking or sleeve formed of a double-layered knitted fabric and wherein, in order to match in the circumferential direction the shape of the body part to be treated, the compression article has a plurality of locations at which, in a row, a stitch increase or a stitch reduction with respect to a preceding row is realized, and in that, moreover, the number of stitches in a wale varies over the circumference of the compression article whereby the compression article is additionally matched, in the longitudinal direction, to the shape of the body part to be treated.

3. The compression article as claimed in claim 1, having a central longitudinal axis that conforms to a central longitudinal axis of the body part to be treated.

4. The compression article as claimed in claim 2, wherein the compression article is a three-dimensional flat or circular knitted fabric.

5. The compression article as claimed in claim 2, wherein the double-layered knitted fabric is closed by a longitudinal seam.

6. The compression article as claimed in claim 2, wherein the compression article is formed of a plurality of strip-shaped segments, which are separated from one another by zones of non-constant width in which the stitch increases or stitch decreases are located.

7. The compression article as claimed in claim 1, wherein the compression article is formed of four strip-shaped segments.

8. The compression article as claimed in claim 1, wherein at least some of the segments have a different number of rows.

9. The compression article as claimed in claim 1, wherein the side margins of the segments are non-parallel to one another.

10. The compression article as claimed in claim 1, comprising one or more elastic yarns.

11. The compression article as claimed in claim 10, wherein the one or more elastic yarns are present as weft threads in the knitted fabric.

12. The compression article as claimed in claim 10, wherein the one or more elastic yarns are present in the circumferential direction or in the longitudinal direction of the knitted fabric.

13. The compression article as claimed in claim 1, wherein the number of stitches in each row is arranged such that in use, the compression pressure exerted on the body part decreases from a distal end of the compression article toward a proximal end of the compression article.

14. The compression article as claimed in claim 1, wherein the fabric is a double-layered or double-faced knitted fabric.

15. A method for producing a compression article on a knitting machine, comprising:

measuring a body part to be supported by the compression article at individual measuring points;

selecting a base pattern for the compression article from a catalogue of base patterns, the measurements of which best conform to the measured body part;

adjusting a stitch count of stitch rows and stitch wales of the base pattern in accordance with the measurements of the body part in a circumferential and longitudinal direction of the body part between the measuring points to define a revised base pattern, wherein the revised base pattern comprises a plurality of longitudinally extending segments, respectively separated from one another in the circumferential direction of the compression article by zones in which the adjustment of the stitch count is implemented;

knitting the revised base pattern on the knitting machine.

16. A method for producing a compression article on a knitting machine, comprising:

measuring a body part to be supported by the compression article, by scanning of the body part;

calculating a necessary number of stitches per stitch row in accordance with a measured circumference of the body part in that region of the body part that is covered by the stitch row;

calculating a necessary number of stitches per wale of the compression article for covering the body part in the longitudinal direction thereof;

calculating points within each stitch row at which a stitch increase or decrease is necessary with respect to a preceding stitch row and at which additional stitches in a wale are required, so that, a central longitudinal axis of the compression article conforms to a central longitudinal axis of the body part;

knitting the compression article, using the calculated stitch counts per stitch row, the calculated points of a stitch increase or decrease in the stitch rows, and the calculated necessary numbers of stitches per wale.

17. The method as claimed in claim 15, wherein knitting of the compression article is performed on a flat-bed knitting machine or on a circular knitting machine.

18. The method as claimed in claim 15, wherein the strip-shaped segments are knitted with common thread guides.

19. The method as claimed in claim 15, wherein the compression article is produced as a seamless tubular knitted fabric.

20. The method as claimed in claim 15, wherein knitting of the compression article takes place using gusseting techniques.

21. The compression article as claimed in claim 2, having a central longitudinal axis that conforms to a central longitudinal axis of the body part to be treated.

22. The compression article as claimed in claim 2, wherein the compression article is a three-dimensional flat or circular knitted fabric.

23. The compression article as claimed in claim 2, wherein the compression article is a seamless tubular knitted fabric.

24. The compression article as claimed in claim 6, wherein the compression article is formed of four strip-shaped segments.

25. The compression article as claimed in claim 6, wherein at least some of the segments have a different number of rows.

26. The compression article as claimed in claim 6, wherein the side margins of the segments are non-parallel to one another.

27. The compression article as claimed in claim 2, comprising one or more elastic yarns.

28. The compression article as claimed in claim 27, wherein the one or more elastic yarns are present as weft threads in the knitted fabric.

29. The compression article as claimed in claim 27, wherein the one or more elastic yarns are present in the circumferential direction or in the longitudinal direction of the knitted fabric.

30. The compression article as claimed in claim 2, wherein the number of stitches in each row is arranged such that in use, the compression pressure exerted on the body part decreases from a distal end of the compression article toward a proximal end of the compression article.

31. The method as claimed in claim 16, wherein knitting of the compression article is performed on a flat-bed knitting machine or on a circular knitting machine.

32. The method as claimed in claim 16, wherein the compression article is produced as a seamless tubular knitted fabric.

33. The method as claimed in claim 16, wherein knitting of the compression article takes place using gusseting techniques.

* * * * *